US009365998B2

(12) United States Patent
Perko

(10) Patent No.: US 9,365,998 B2
(45) Date of Patent: Jun. 14, 2016

(54) ELEVATED EQUIPMENT ASSEMBLIES, EQUIPMENT-SUPPORTING PLATFORMS, AND RELATED METHODS

(71) Applicant: Magnum Piering, Inc., West Chester, OH (US)

(72) Inventor: Howard A. Perko, Fort Collins, CO (US)

(73) Assignee: Magnum Piering, Inc., West Chester, OH (US)

( * ) Notice: Subject to any disclaimer, the term of this patent is extended or adjusted under 35 U.S.C. 154(b) by 0 days.

(21) Appl. No.: 14/068,071

(22) Filed: Oct. 31, 2013

(65) Prior Publication Data

US 2014/0119838 A1 May 1, 2014

Related U.S. Application Data

(60) Provisional application No. 61/721,084, filed on Nov. 1, 2012.

(51) Int. Cl.
*E02D 5/56* (2006.01)
*E02D 5/22* (2006.01)
*E02D 27/52* (2006.01)

(52) U.S. Cl.
CPC .. *E02D 5/56* (2013.01); *E02D 5/22* (2013.01); *E02D 27/52* (2013.01)

(58) Field of Classification Search
CPC ..... E02D 5/56; E02D 5/80; E02D 5/801; E02D 27/50; E01D 19/005; E04B 1/34347; E04B 1/34352
USPC ..... 405/230, 231, 244, 252.1, 255; 52/157, 52/DIG. 11
See application file for complete search history.

(56) References Cited

U.S. PATENT DOCUMENTS

| | | | | |
|---|---|---|---|---|
| 3,427,812 | A | 2/1969 | Hollander | |
| 4,890,959 | A * | 1/1990 | Robishaw et al. | 405/204 |
| 6,058,662 | A | 5/2000 | Perko | |
| 6,094,873 | A * | 8/2000 | Hoffman et al. | 52/126.6 |

(Continued)

FOREIGN PATENT DOCUMENTS

JP 2001064978 A 3/2001

OTHER PUBLICATIONS

Weatherford Brochure, Rotaflex® Long-Stroke Pumping Unit, www.weatherford.com <http://www.weatherford.com>, 2007 (4 pages).

(Continued)

*Primary Examiner* — Tara M. Pinnock
(74) *Attorney, Agent, or Firm* — Wood Herron & Evans LLP

(57) ABSTRACT

An elevated equipment assembly includes operating equipment situated atop a platform above grade. Piles are installed into the ground with free ends thereof extending above grade, and pile caps are coupled to the free ends of the piles. Each pile cap includes a cap plate disposed in a generally horizontal orientation. A platform is situated atop the pile caps and includes two longitudinally-extending structural beams and cross beams spanning between the two structural beams. Attachment members are secured to and extend outwardly from the outboard side of each structural beam. Each attachment member includes a generally flat attachment plate disposed in a generally horizontal orientation and secured to a cap plate of a pile cap.

50 Claims, 9 Drawing Sheets

(56) References Cited

U.S. PATENT DOCUMENTS

| | | | | |
|---|---|---|---|---|
| 6,128,867 | A * | 10/2000 | MacKarvich | 52/157 |
| D612,954 | S | 3/2010 | Perko | |
| 2002/0079421 | A1 | 6/2002 | Harris | |
| 2007/0028533 | A1 * | 2/2007 | Stroyer | 52/126.6 |
| 2013/0309024 | A1 * | 11/2013 | Jones | 405/252.1 |

OTHER PUBLICATIONS

Pumping Unit, Ukraine: <http://www.dreamstime.com/stock-photos-oil-pump-jack-operation-pumpjack-nodding-horse-pumping-unit-ukraine-crimean-peninsula-image31943173>, photograph obtained by Applicant and depicted system believed by Applicant to have been on sale and in public use prior to Nov. 1, 2012.

Pumping Unit, Duri, Indonesia: <http://www.virtualtourist.com/travel/Asia/Indonesia/Riau_Province/Duri-1219797/TravelGuide-Duri.html>, photograph obtained by Applicant and depicted system believed by Applicant to have been on sale and in public use prior to Nov. 1, 2012.

Slant-Hole Pumping Unit, China: <http://www.jzchinapetro.com/html/Products/PUMPING_UNIT/Slant-hole_Pumping_Units/93.html>, photograph obtained by Applicant and depicted system believed by Applicant to have been on sale and in public use prior to Nov. 1, 2012.

Engineer with Pumping Unit: <http://footage.shutterstock.com/clip-3963826-stock-footage-man-engineer-with-securities-for-the-oil-pumping-unit.html>, photograph obtained by Applicant and depicted system believed by Applicant to have been on sale and in public use prior to Nov. 1, 2012.

Shutterstock 70039861: <http://www.shutterstock.com/pic-70039861/stock-photo-oil-and-gas-industry-work-of-oil-pump-jack-on-a-oil-field-white-clouds-and-blue-sky.html>, photograph obtained by Applicant and depicted system believed by Applicant to have been on sale and in public use prior to Nov. 1, 2012.

Shutterstock 73501597: <http://www.glomacs.ae/Public-Seminars>, photograph obtained by Applicant and depicted system believed by Applicant to have been on sale and in public use prior to Nov. 1, 2012.

Shutterstock 75434245: <http://www.shutterstock.com/pic-75434245/stock-photo-oil-pump-jack-on-a-white-background-d-rendering.html>, photograph obtained by Applicant and depicted system believed by Applicant to have been on sale and in public use prior to Nov. 1, 2012.

European Patent Office, International Search Report & Written Option issued in corresponding application No. PCT/US2013/067755, mailed Jan. 28, 2015, 14 pp.

Three photographs that were obtained by Applicant and showing a system believed to have been on sale and in public use prior to Nov. 1, 2012, and which photographs are understood by Applicant to have been taken in Alberta on Mar. 24, 2012.

* cited by examiner

ELEVATED EQUIPMENT ASSEMBLIES, EQUIPMENT-SUPPORTING PLATFORMS, AND RELATED METHODS

RELATED APPLICATION

This application claims the benefit of U.S. Provisional Application No. 61/721,084, filed Nov. 1, 2012, the content of which is hereby incorporated by reference in its entirety.

FIELD OF THE INVENTION

The present invention relates to structures for supporting operating equipment, and more particularly, to structures for supporting operating equipment above grade.

BACKGROUND

Heavy operating equipment is typically positioned in a fixed location on a concrete pad or the like formed or set on the ground so that the equipment will be held at grade in a fixed location. By way of example, a horsehead oil pump has a pivoting beam coupled with a piston in a well to pump oil therefrom. The oil pump must maintain a fixed position aligned with the well for proper operation. Unfortunately, the concrete pad is susceptible to damage or shifting due to expansive soils, frost heave, wetting and drying cycles, and other processes, which can result in undesirable shifting of the operating equipment from its appropriate position. Such changes in the position of the oil pump can lead to failure of the pump and/or damage to the well.

Moreover, the use of concrete pads becomes difficult if the location of the operating equipment is in a remote area. The pads can be quite large, making them difficult to transport if pre-cast. And the volumes of concrete needed can be challenging to transport to the location, if the pad is to be made on-site.

SUMMARY OF THE INVENTION

The present invention provides improvements in the way operating equipment is supported so as to minimize or eliminate risk of undesired shifting of the equipment. To this end, and in accordance with the principles of the present invention, piles installed deep in the ground have free ends disposed above grade each with a pile cap associated with each free end defining a generally horizontally disposed cap plate, and a platform having two longitudinally-extended beams with generally flat plates of attachment members secured to and extending outwardly from the outboard sides of the beams, each attachment member secured to a respective cap plate so as to support a piece of operating equipment on the platform. As a result, the platform is held above grade by piles that remain fixed in position in the ground thereby minimizing or eliminating damage or shifting of the platform due to expansive soils, frost heave, wetting and drying cycles, and other processes. Advantageously, the platform is made from steel members, thus avoiding the need to transport large volumes of concrete or concrete pads such as to remote locations.

The piles and platform components can be provided as a kit unassembled for easy transport to a site location. At the site, the piles are driven into the ground, the free ends adapted with the pile caps such as by trimming the free ends to desired height(s) and securing the pile caps thereto, and the platform positioned over the free ends of the piles such that the attachment member plates confront respective ones of the pile cap plates, which are then secured together. Thus, there is no need for large concrete pads or volumes of concrete to be transported or handled at the site.

Where the operating equipment is a horsehead oil pump, in accordance with an aspect of the invention, the platform is advantageously made of steel, with the two longitudinal structural beams supported on a plurality of helical piles in a particular arrangement. In that regard, ten helical piles may be used, with three pairs of them arranged in a vertical orientation under the platform, one pair at the front end near the well head extending in a forwardly battered and outwardly splayed out configuration, and one pair at the back end remote from the well head extending in a rearwardly battered configuration. The back end piles may also be outwardly splayed. An eleventh vertical pile may be included between the forwardmost pair of vertical piles. Advantageously, the three pairs of vertical piles are placed on nine foot centers, with the battered pile pairs at the front and back connecting at their free ends at a spacing of three feet from the respective forwardmost and rearwardmost pairs of vertical piles.

By virtue of the foregoing, there are thus provided improvements in the way operating equipment is supported so as to minimize or eliminate risk of undesired shifting of the equipment. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
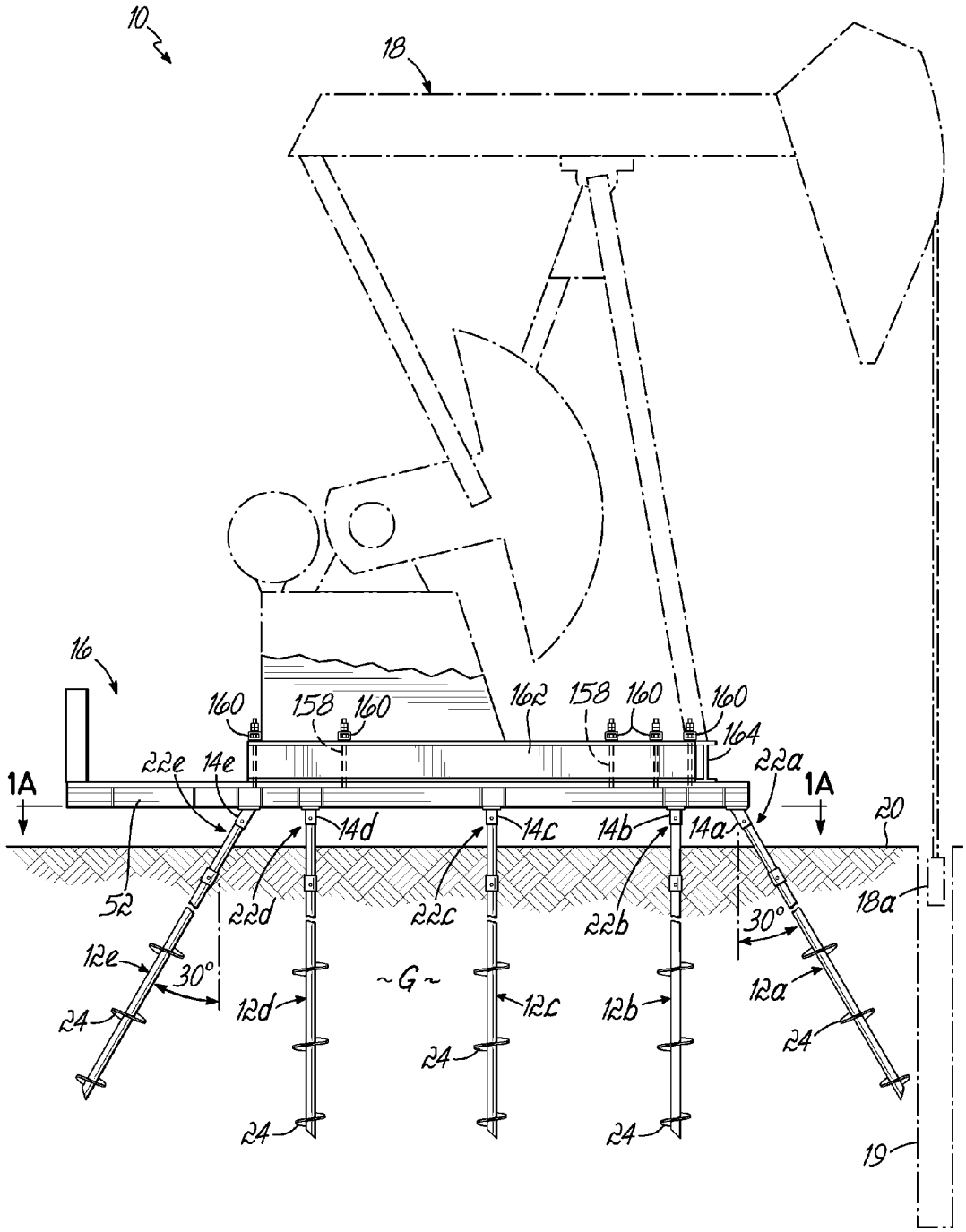
FIG. 1 is a schematic depiction showing an elevated equipment assembly constructed in accordance with principles of the present invention and including a platform situated atop a plurality of piles installed into the ground. The elevated equipment assembly is shown supporting a horsehead oil pump above grade.
Figure 1A:
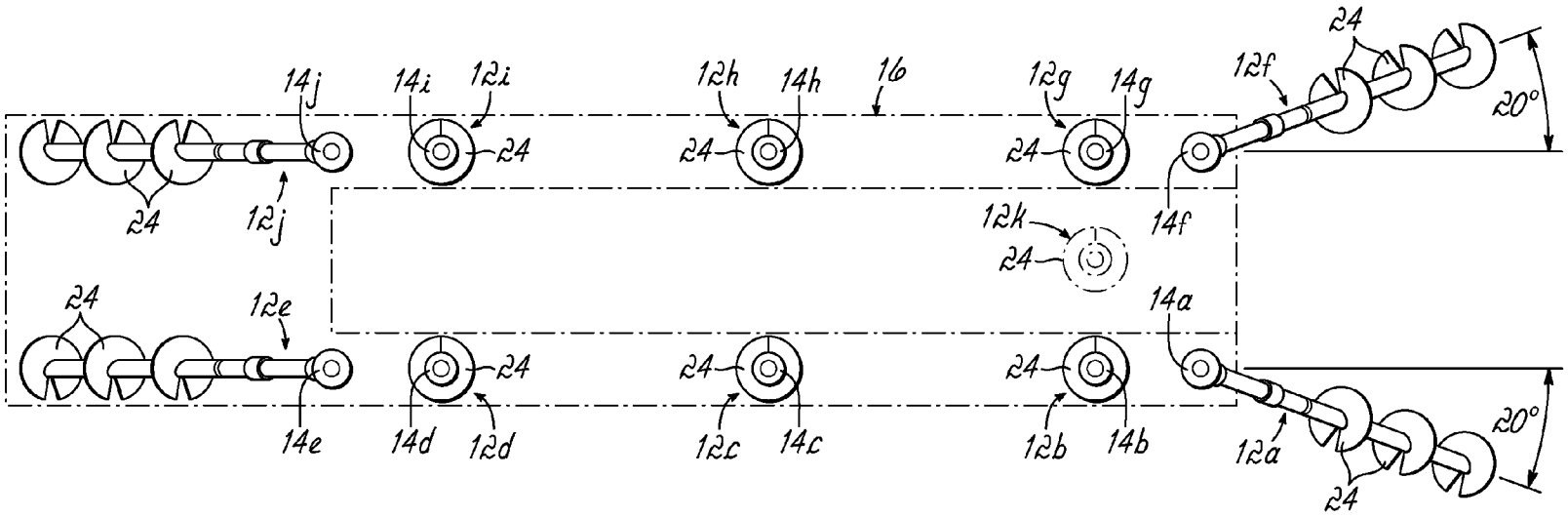
FIG. 1A is a schematic top view taken along line 1A-1A of FIG. 1 and showing the orientation of the plurality of piles supporting the platform of FIG. 1.

With reference to FIGS. 1 and 1A, there is shown an elevated equipment assembly 10 in accordance with the principles of the present invention. The elevated equipment assembly 10 generally includes a plurality of piles 12 (piles 12*a*, 12*b*, 12*c*, 12*d*, and 12*e* on one side, as shown in FIG. 1, and a mating set of piles 12*f*, 12*g*, 12*h*, 12*i*, and 12*j* on the other side, as shown in FIG. 1A), a plurality of pile caps 14 (pile caps 14*a*, 14*b*, 14*c*, 14*d*, 14*e* associated with piles 12*a*, 12*b*, 12*c*, 12*d*, and 12*e*, and pile caps 14*f*, 14*g*, 14*h*, 14*i*, and 14*j* associated with piles 12*f*, 12*g*, 12*h*, 12*i*, and 12*j*, respectively, with pile caps 14*f*, 14*g*, 14*i*, and 14*j* not shown, pile cap 14*h* shown in FIGS. 4 and 5), and a platform 16 situated atop the pile caps 14. A piece of heavy operating equipment 18 is supported atop the platform 16 above grade 20. In the embodiment shown, the operating equipment 18 is a horsehead oil pump and is situated with its piston 18*a* extending into a well head 19 forwardly of the assembly 10. It will be appreciated that other types of heavy operating equipment could also be supported by the platform 16.

Each pile 12 is installed deep into the ground G such that a free end 22 thereof extends above grade 20. Particularly, the piles 12 are installed deep enough in the ground to be effective for supporting the platform 16 and the operating equipment 18, as described herein. In the embodiment shown, the piles 12*b*, 12*c*, 12*d*, 12*g*, 12*h*, and 12*i* are installed into the ground G so as to have a generally vertical orientation with pile pair 12*b*, 12*g* being the forwardmost pair and pile pair 12*d*, 12*i* being the rearwardmost pair, with pair 12*c*, 12*h* being intermediate therebetween. Pile pairs 12*b*, 12*g* and 12*d*, 12*i* are spaced from intermediate pile pair 12*c*, 12*h*. Piles 12*a*, 12*f* are installed into the ground G forward of pile pair 12*b*, 12*g* so as to have a generally forwardly extending battered orientation such as at 30° to vertical (FIG. 1) and, advantageously, splayed outwardly such as at 20° off longitude (FIG. 1A). Piles 12*e*, 12*j* are installed into the ground G rearward of pile pair 12*d*, 12*i* so as to have a generally rearwardly extending battered orientation such as at 30° to vertical (FIG. 1). Piles 12*e*, 12*j* could also be splayed (not shown). Thus, pile pairs 12*a*, 12*f* and 12*e*, 12*j* are at an oblique angle in the ground G but in opposite directions. Also, the piles 12 are depicted in the figures as helical piles, which include helically-arranged blades 24 for engaging the ground, which is particularly advantageous for some operating equipment 18, such as horsehead oil pumps. It will be appreciated that the principles of the present invention are also generally applicable to other pile installation configurations and other pile types.

Each pile cap 14 is configured to be coupled to a free end 22 of a pile 12, and includes a cap plate 30 and a sleeve portion 32, also referred to as a receiver sleeve. The cap plate 30 is secured to the sleeve portion 32, and the sleeve portion 32 fits around a respective free end 22 of a pile 12 when a pile cap 14 is coupled to a pile 12. A pile cap 14 may be secured to a pile 12 in any appropriate manner. For example, each sleeve portion 32 of a pile cap 14 may include one or more sleeve apertures 34, and each free end 22 of a pile 12 may include one or more corresponding pile apertures 36. A sleeve portion 32 may be secured to a pile 12 by a fastening member 38, such as a bolt, received in respective aligned sleeve apertures 34 and pile apertures 36.

As shown in FIG. 1, all the cap plates 30 are disposed in a generally horizontal orientation when the pile caps 14 are coupled to the piles 12. Thus, for the piles 12*b*, 12*c*, 12*d*, the cap plates 30 are oriented generally transverse to the lengthwise axis of those respective piles. And for the piles 12*a*, 12*e*, the cap plates 30 are oriented at an oblique angle relative to the lengthwise axis of those respective piles. Moreover, all the cap plates 30 are disposed in generally the same horizontal plane. Thereby, the cap plates 30 provide a plurality of locations for supporting the platform 16.

The pile caps 14 are coupled to the free ends 22 of the piles 12 before the platform 16 is positioned on the pile caps 14. In some instances it may be necessary to trim a free end 22 of a pile 12 before coupling a pile cap 14 thereto. For example, after piles 12 are installed into the ground G, various free ends 22 thereof may require trimming so that all the free ends 22 extend to generally the same height above grade 20. Then, the pile caps 14 may be coupled to the free ends 22.

The platform 16 is situated atop and secured to the pile caps 14. In particular, the platform 16 includes a plurality of attachment members 50 that rest on and are secured to the pile caps 14.

With reference to FIGS. 2, 3, 5, 8, and 9 the platform 16 includes two longitudinally-extending structural beams 52, 54. The structural beams 52, 54 are spaced apart and are oriented generally parallel with one another. Each structural beam includes an inboard side and an outboard side: structural beam 52 has an inboard side 56 and an outboard side 58, and structural beam 54 has an inboard side 60 and an outboard side 62. The inboard sides 56, 60 of the structural beams 52, 54 face each other. The structural beams 52, 54 include respective lower surfaces 64, 66 and upper surfaces 68, 70. The lower surfaces 64, 66 define a lower plane 72 of the platform 16, and the upper surfaces 68, 70 define an upper plane 74 of the platform 16. As shown, the structural beams 52, 54 have a general I-beam configuration, and may be formed of steel.

Figure 4:
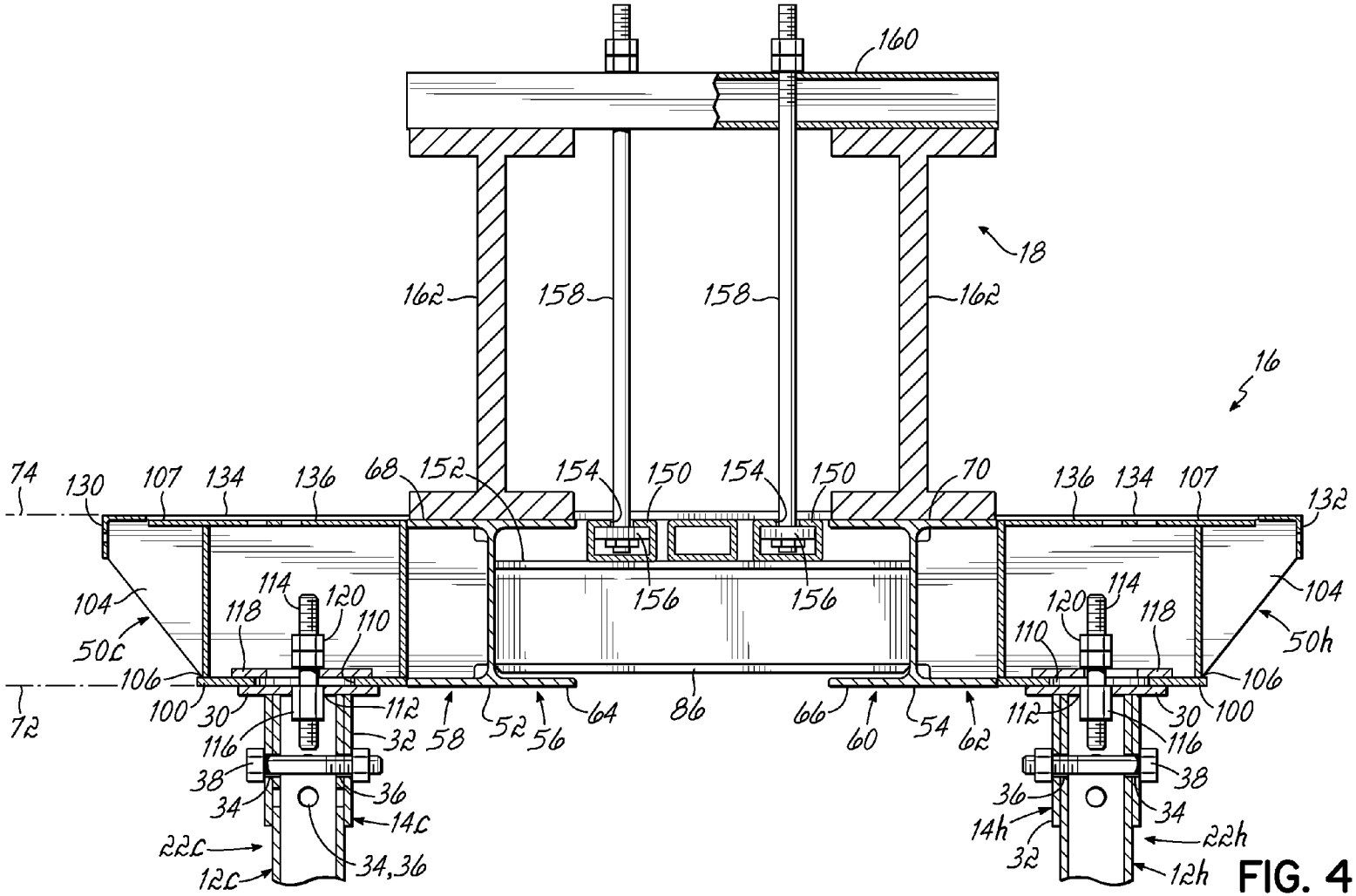
FIG. 4 is a sectional view taken along line 4-4 of FIG. 2.
Figure 5:
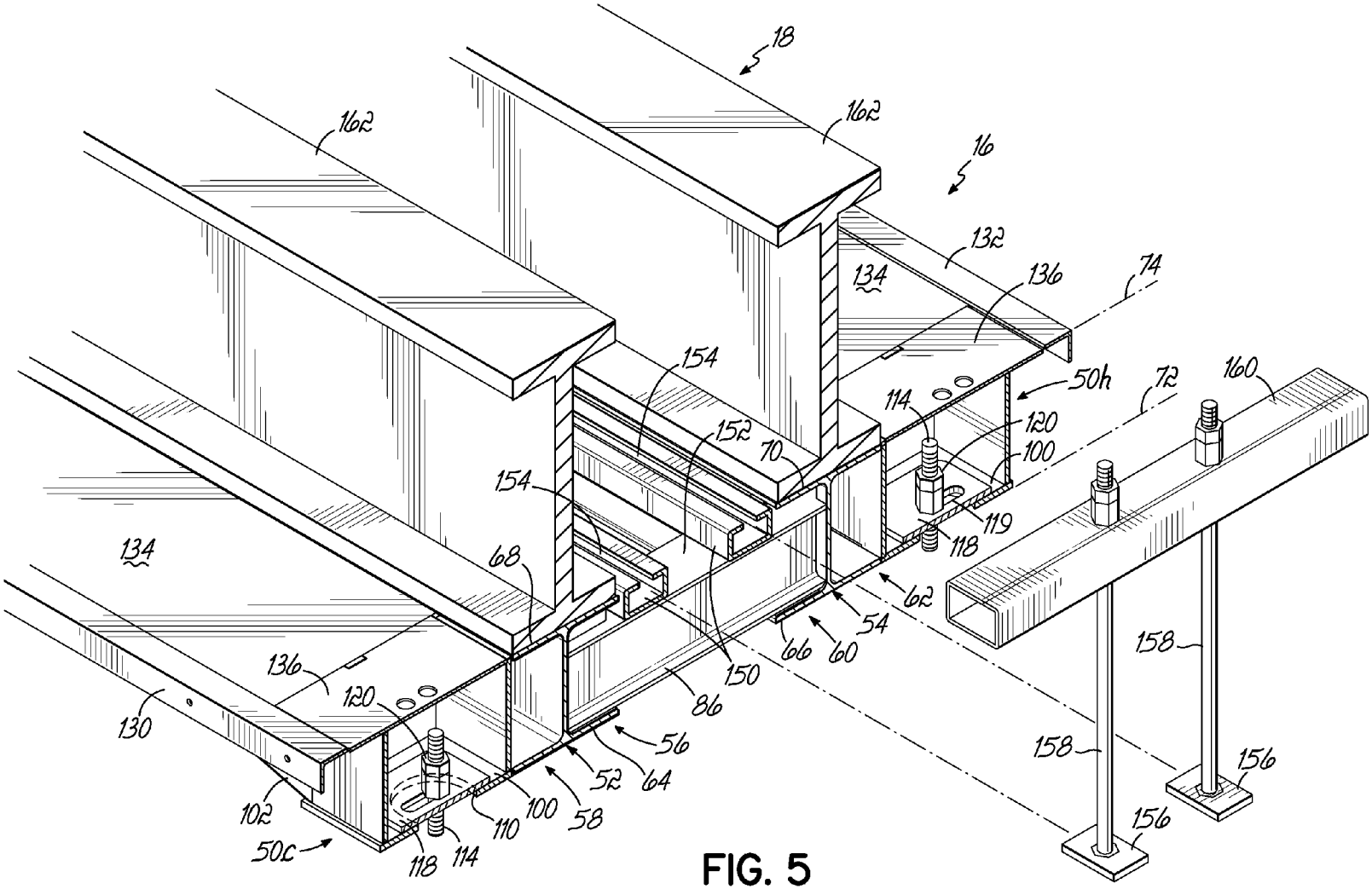
FIG. 5 is an isometric view in partial cross-section showing the relationship between a brace bar and tie bars with channel rails for securing the oil pump to the platform.
Figure 6:
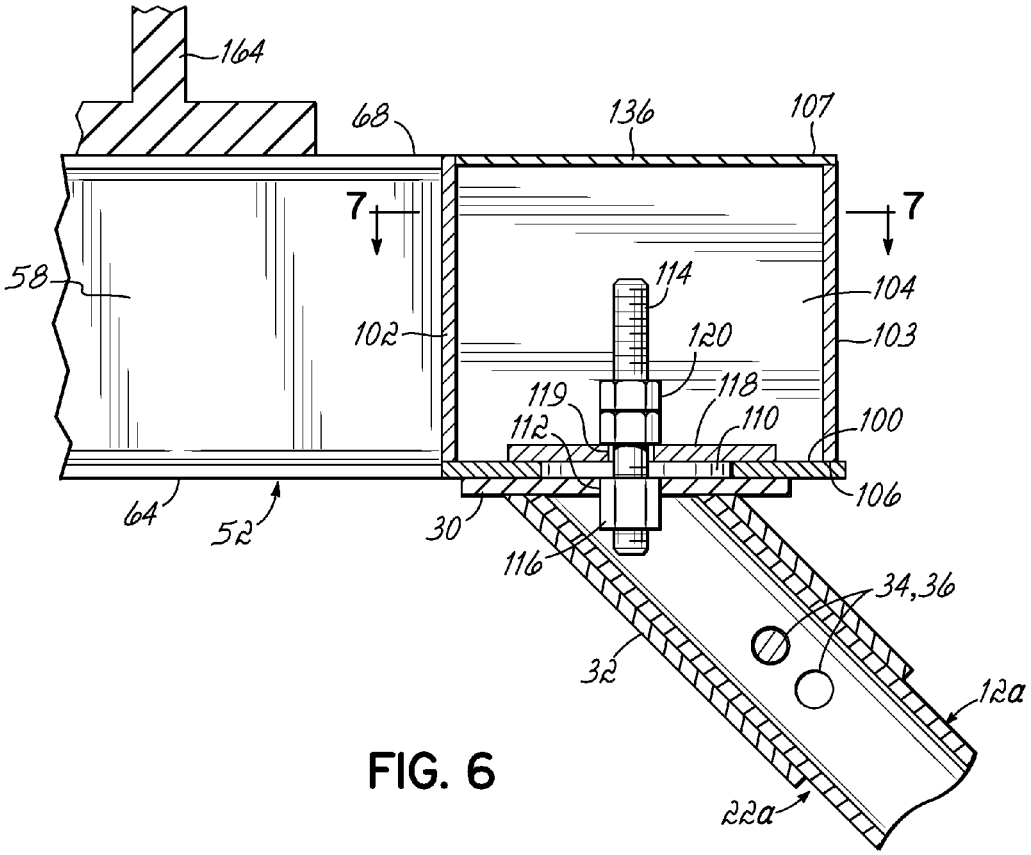
FIG. 6 is a side view in partial cross-section showing the relationship between the platform and a pile of the elevated equipment assembly of FIG. 1.
Figure 7:
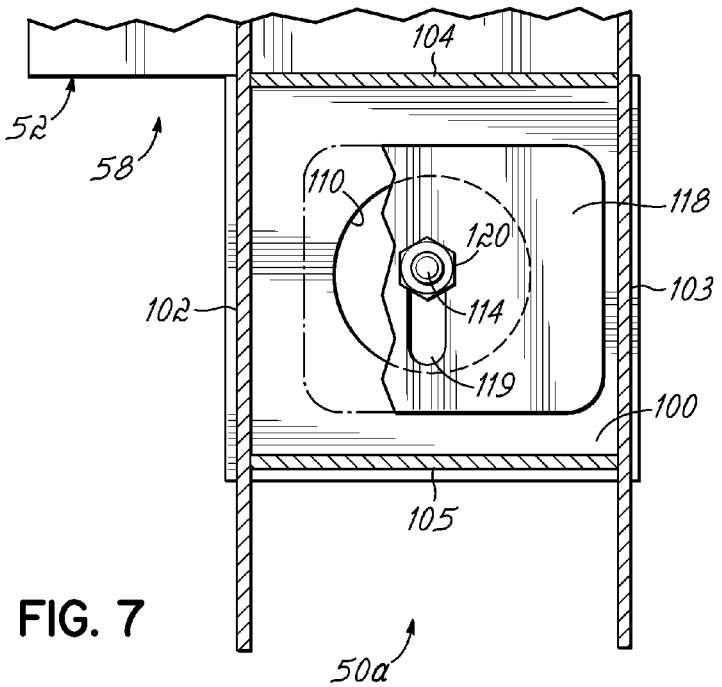
FIG. 7 is a cross-sectional view taken along line 7-7 of FIG. 6.
Figure 8:
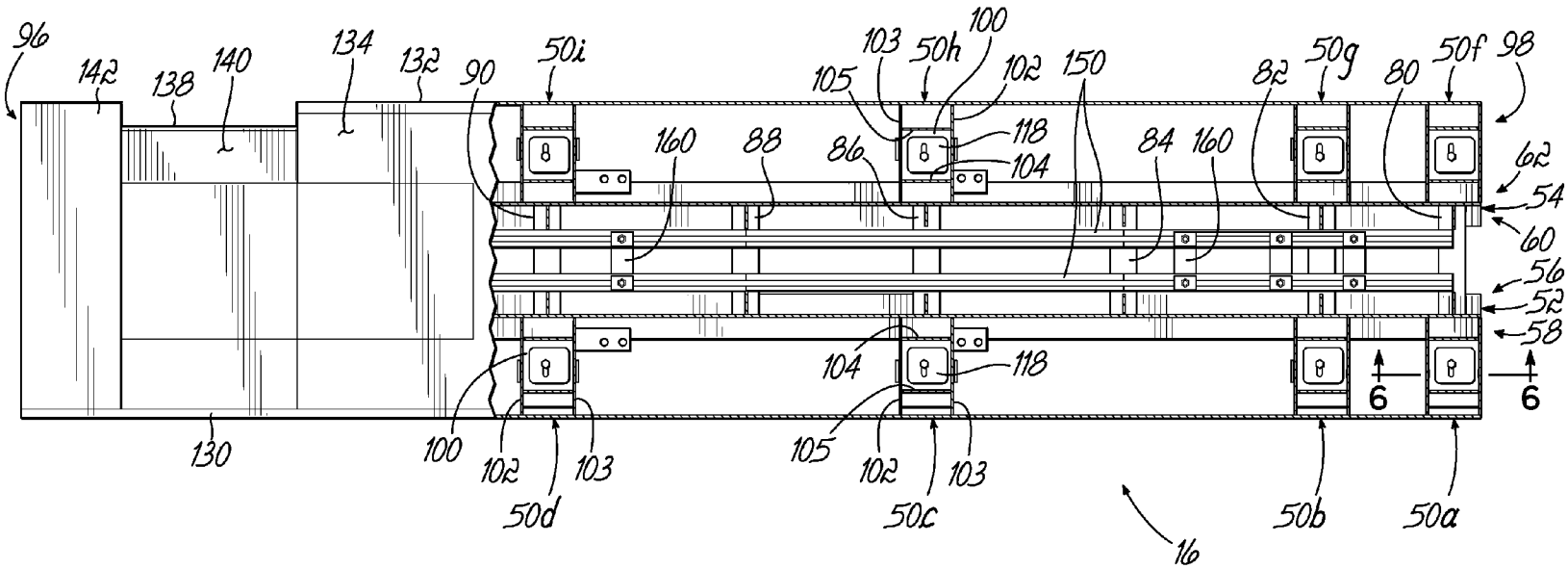
FIG. 8 is a plan view partially broken away and showing the platform of FIG. 1.
Figure 9:
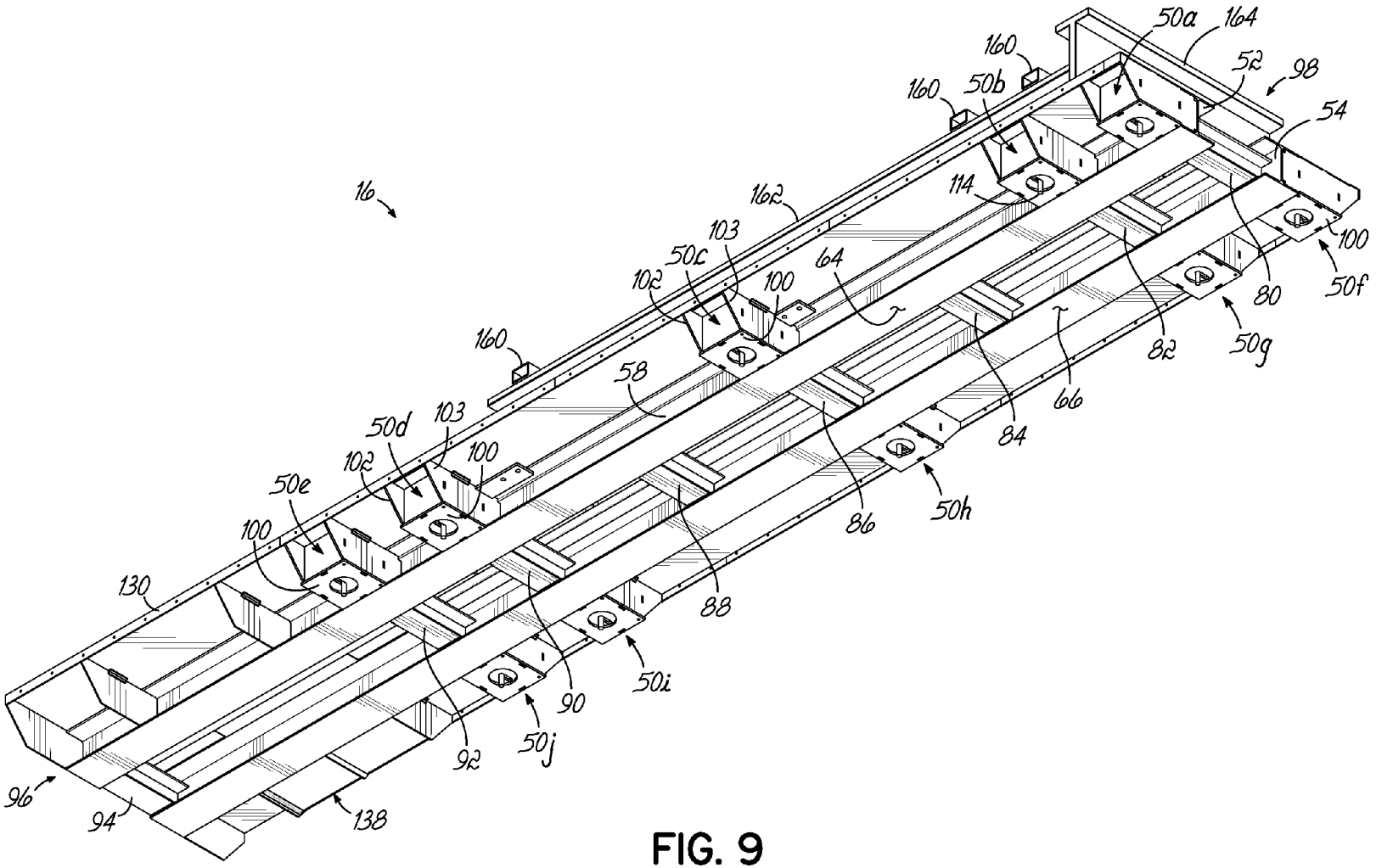
FIG. 9 is an isometric bottom view of the platform of FIG. 1.

The platform 16 also includes a plurality of cross beams 80, 82, 84, 86, 88, 90, 92, and 94 (FIG. 8) that span between the structural beams 52, 54. In particular, the cross beams 80, 82, 84, 86, 88, 90, 92, and 94 are secured to the inboard sides 56, 60 of the structural beams 52, 54. As shown in FIGS. 4 and 5, the cross beams 80, 82, 84, 86, 88, 90, 92, 94 are positioned generally between the upper plane 74 and the lower plane 72, and have a general I-beam configuration, and may be formed of steel. Advantageously, the structural beams 52, 54 extend generally from a rearward end 96 to a forward end 98 of the platform.

The attachment members 50 (attachment members 50*a-j* shown) are secured to and extend outwardly from the outboard sides of the structural beams 52, 54. Particularly, attachment members 50*a-e* are secured to and extend outwardly from the outboard side 58 of the structural beam 52, and attachment members 50*f*-50*j* are secured to and extend outwardly from the outboard side 62 of the structural beam 54. Each attachment member 50 includes a generally flat attachment plate 100 that is disposed in a generally horizontal orientation. Each attachment plate 100 rests on and is secured to a cap plate 30 of a pile cap 14 when the platform 16 is positioned on the pile caps 14.

As shown in FIGS. 4 and 5, each attachment plate 100 is generally oriented in the lower plane 72 of the platform 16, which is generally parallel with the upper plane 74. The attachment plates 100 are all generally coplanar with each other in the lower plane 72. Each attachment member 50 also includes a first gusset plate 102 and a second gusset plate 103, both of which extend upwardly from the attachment plate 100 toward the upper plane 74 of the platform 16. The gusset plates 102, 103 are spaced from one another and extend outwardly from the outboard sides (either 58 or 62) of a respective structural beam 52, 54 (FIGS. 4 and 5). Spanning between gusset plates 102, 103 are side plates 104, 105 to define, with gusset plates 102, 103 a box shape with attachment plate 100 being at the bottom 106 thereof. Thus, attachment members 50 may also be seen as box receivers. The gusset plates 102, 103, and side plates 104, 105 include respective upper surfaces 107 that are generally oriented in the upper plane 74 of the platform 16.

As shown in FIGS. 4-7, each attachment plate 100 includes an attachment plate aperture 110. In addition, each cap plate 30 includes a cap plate aperture 112. The cap plates 30 and attachment plates 100 are secured together by fastening members 114 received in respective aligned cap plate apertures 112 and attachment plate apertures 110. In particular, a first threaded member 116 is in the pile cap 14 near the cap plate 30, and may be fixedly attached with the pile cap 14, such as by welding, so as to be aligned with the cap plate aperture 112. In that way, the fastening member 114 extending through the cap plate aperture 112 is threaded into the first threaded member 116. A washer 118 having a slot 119 is positioned around the fastening member 114 above the attachment plate aperture, and a second threaded member 120 is threaded onto the fastening member 114 above the washer 118. Advantageously, the attachment plate aperture 110 may be oversized relative to the fastening member 114, such as being elongated in an axis transverse to the platform 16, to aid in the alignment and securement between an attachment member 50 and a pile cap 14.

As shown in the figures, each attachment member 50 is generally opposite one of the respective structural beams 52, 54 from a respective cross beam 80, 82, 86, 90, 92. Of course, other positions of the attachment members 50 are also possible.

The platform 16 also includes two longitudinally-extending outer beams 130, 132, which are positioned outwardly of the outboard sides 58, 62 of the respective structural beams 52, 54. The outer beams 130, 132 are secured to the first and second gusset plates 102, 104 of the various attachment members 50. As shown in FIGS. 4 and 5, the outer beams 130, 132 have a general angle-iron configuration.

Figure 2:
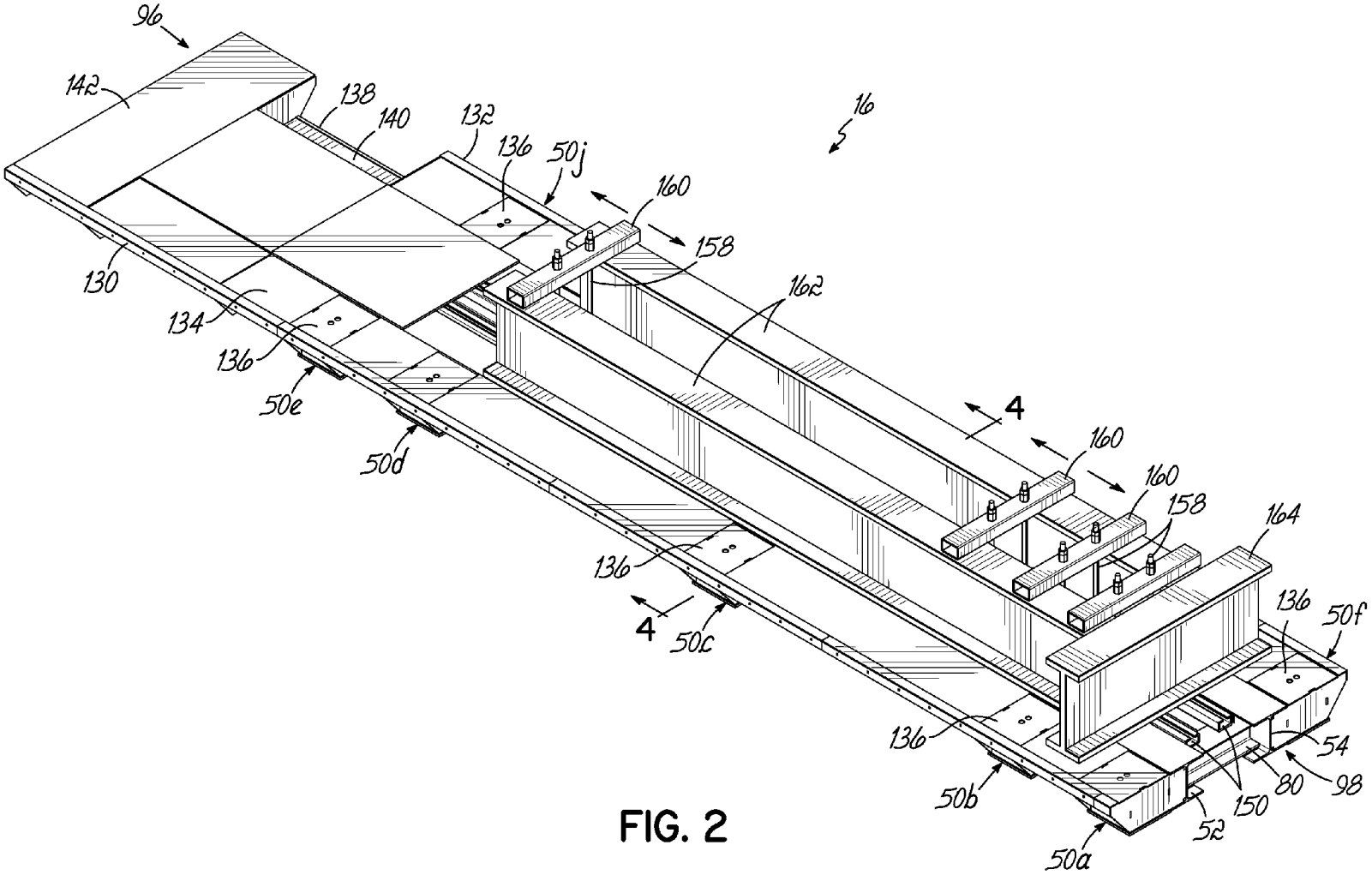
FIG. 2 is an isometric view showing the platform of FIG. 1, with leg members of the oil pump shown secured to the platform.
Figure 3:
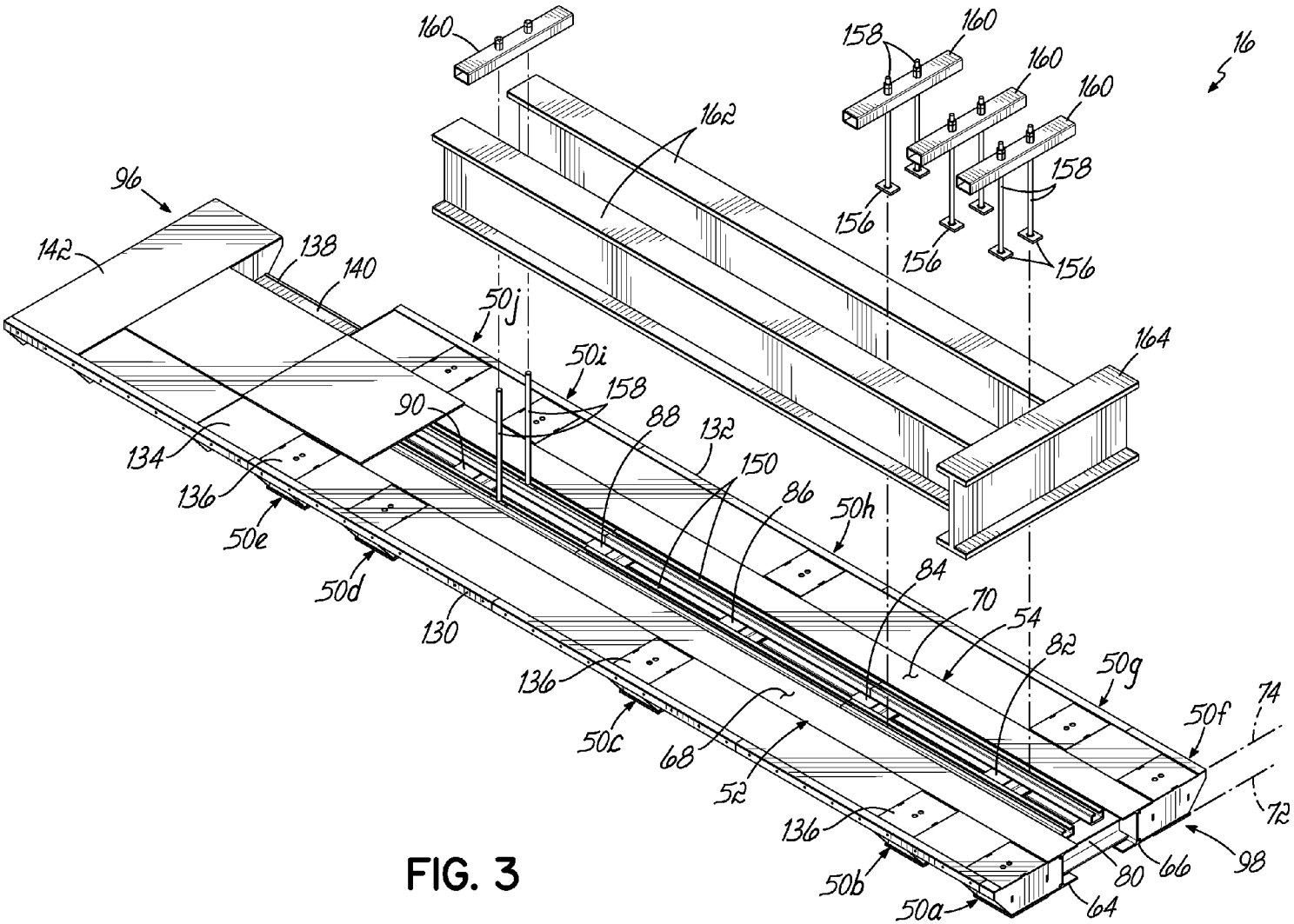
FIG. 3 is an isometric disassembled view of the arrangement shown in FIG. 2.

The platform 16 also includes a steel grating 134 positioned atop the structural beams 52, 54 (FIGS. 2-5). Removable access panels 136 are provided in the steel grating 134 for accessing features of the attachment members 50 beneath the steel grating 134. For example, the access panels 136 may be removed so that ropes can be secured to the attachment plate apertures 110 for the purpose of lifting and moving the platform 16. The steel grating 134 provides a surface on the platform 16 on which a user may walk or where devices relating to the operating equipment 18 may be positioned. The platform 16 also includes a step 138 which provides a surface for a user to step onto while ascending or descending the platform 16. As shown in FIGS. 2 and 3, the step 138 is positioned between the lower plane 72 and the upper plane 74 of the platform 16. The step 138 also includes steel grating 140. The platform 16 also includes a transverse plate 142 that is positioned generally above the upper plane 74 and at a longitudinal end 144 of the platform 16. The transverse plate 142 provides a surface where a user may walk or where devices relating to the operating equipment 18 may be positioned.

The platform 16 also includes structure for securing the operating equipment 18 to the platform 16. In the embodiment shown, and as shown in FIGS. 3 and 4, this includes one or more channel rails 150 secured to upper surfaces 152 of the cross beams 80, 82, 84, 86, 88, 90, 92, 94. The channel rails 150 are located between the structural beams 52, 54, and each includes an opening 154 generally opposite the upper surfaces 152. The opening 154 is configured to receive a foot portion 156 of a tie bar 158. The foot portion 156 is retained by the channel rail 150. A brace bar 160 is positioned on, or attached to, the tie bar 158 generally opposite the foot portion 156. The brace bar 160 is configured to be put over a portion of the operating equipment 18. For example, and as shown in FIGS. 2 and 3, the brace bar 160 is positioned over leg members 162 of the operating equipment 18, and the tie bars 158 are connected with the channel rails 150 to secure the operating equipment 18 to the platform. The brace bar 160 is connected to the channel rails 150 through the tie bars 158, and holds the operating equipment 18 against the platform 16. A cross member 164 is situated on the platform 16 near the end 98, as shown.

In addition, and although they are not shown, the platform can include tie-down apertures that are configured to receive a fastener, such as a bolt, for securing the operating equipment 18 to the platform with such fasteners. For example, the operating equipment 18 may be bolted to the platform 16 by fasteners received in the tie-down apertures.

The operating equipment 18 may therefore be supported atop the platform 16 above grade 20 as follows. First, the piles 12 are installed into the ground such that free ends 22 thereof extend above grade 20. In some cases, this may include installing a first plurality of piles 12 (such as piles 12*b*-12*d* and 12*g*-12*i*) at a generally vertical orientation in the ground G, and a second plurality of piles 12 (such as piles 12*a*, 12*f* forward of piles 12*b*, 12*g*, and piles 12*e*, 12*j* rearward of piles 12*d*, 12*i*) at a generally oblique angle in the ground G. Advantageously, piles 12*a*, 12*f* are installed in a forwardly oblique battered and outwardly splayed orientation, with piles 12*e*, 12*j* installed in a rearwardly oblique battered orientation (and may also be splayed). The piles 12 advantageously include helical piles having helically-arranged blades 24. If required, the free ends 22 of one or more of the piles 12 may require trimming to an appropriate height above grade 20.

Then, the pile caps 14 are coupled to the free ends 22 of the piles 12. The sleeve portions 32 of the pile caps 14 are placed onto and fit around the free ends 22. The pile caps 14 may be secured to the piles 12. For example, a fastening member 38 may be installed in respective aligned sleeve apertures 34 and pile apertures 36.

After the pile caps 14 are coupled to the piles 12, the platform 16 is positioned above the pile caps 14. The platform 16 is moved to bring the attachment members 50, and in particular the attachment plates 100, into confronting relationship with the cap plates 30 of the pile caps 14. The attachment plates 100 are secured to the cap plates 30. For example, a fastening member 114 may be positioned in respective aligned attachment plate apertures 110 and cap plate apertures 112.

The operating equipment 18 may then be positioned atop the platform 16. The operating equipment 18 may be secured to the platform 16. For example, a brace bar 160 can be positioned over a portion of the operating equipment 18. The brace bar 160 is connected to a channel rail 150 secured to the platform 16 through a tie bar 158. In addition, the operating equipment 18 may be bolted to the platform 16.

Advantageously, where the operating equipment 18 is a horsehead oil pump, the platform 16 is eight feet wide and 34 feet long (between ends 96 and 98), with the pump 18 situated thereon to extend between the free ends 22 of the forward battered piles 12*a*, 12*f* at the forward end 98 and the free ends 22 of the rearward battered piles 12*e*, 12*j*. The piles 12 are installed such that the free ends 22 of pile pairs 12*b*, 12*g* and 12*d*, 12*i* are spaced from intermediate pile pair 12*c*, 12*h* on nine foot centers, the free ends 22 of forward battered pile pair 12*a*, 12*f* are spaced three feet forward of pile pair 12*b*, 12*g*, and the free ends 22 of rearward battered pile pair 12*e*, 12*j* are spaced three feet rearward of pile pair 12*d*, 12*i*. Piles 12 are advantageously rotatably installed to a depth of at least twelve feet and a minimum installation torque of 12,600 ft-lb. at locations providing the above-described spacing and rearward of the well head 19 such that with platform 16 mounted thereon, the forward end 98 of the platform 16 is spaced eight to twelve feet from the well head 19, but other distances may be appropriate depending upon the nature of the pump 18. The forward, battered piles 12*a*, 12*f* are splayed outwardly so as to avoid interference with the well head 19. As a consequence, the piston 18*a* of the pump 18 is positioned properly to cooperate with pump 18 into and out of the well head 19. The result is to provide a horsehead oil pump that is held to a steel platform secured, above grade, to helical piles secured in the ground, which results in improvements in the way such pumps are supported so as to minimize or eliminate the risk of undesired shifting thereof relative to the well head and/or undue or excessive vibration, and of which may be encountered in the prior approach of placing the pump on a concrete pad on the ground.

In addition, a kit may be provided that includes a plurality of the piles 12, a plurality of the pile caps 14, and a platform 16, all as described above. The piles 12, pile caps 14, and platform 16 may be assembled, as discussed above, to provide an elevated equipment assembly for supporting operating equipment above grade.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, while the platform 16 is described as having two, longitudinally extending structural beams 52, 54 with cross beams 80, 82, 84, 86, 88, 90, 92, and 94 spanning therebetween, it will be appreciated that additional longitudinally extending structural beams (not shown) could be included, with the cross beams spanning between respective beams so as to, collectively, be considered as spanning between structural beams 52, 54. Further, attachment members 50 are shown as secured to the outboard sides of the structural beams 52, 54, but could be affixed elsewhere, such as to other structural beams, if included. And although the platform 16 and free ends 22 of the piles 12 are shown as being secured to each other via pile caps 14 and attachment members 50, in some embodiments, the free ends 22 of one or more of the piles 12 or the pile caps 14 may be secured, such as by welding, directly to the platform 16, such as to the structural and/or cross beams thereof.

Also, in addition to the ten piles 12 describe above, other or different numbers of piles could be used depending on the nature of the operating equipment. By way of example, and not limitation, where the operating equipment 18 is a horsehead oil pump, some installations may benefit from an eleventh, vertically installed helical pile 12*k* (shown in dotted line in FIG. 1A) between forwardly positioned vertical pile pair 12*b*, 12*i*. In that case, the cross beam(s) positioned there may be replaced with an attachment member (not shown), to mate to a pile cap (also not shown) formed on the free end of pile 12*k*. The attachment member may be larger than attachment members 50, such as with longer gussets, and be secured to one or both of the structural beams 52, 54 to span therebetween. Still further, while it is contemplated that some or all of the components of the pile caps 14 and the platform 16 may be formed of steel, they may also be constructed of any other suitable other material or materials, such as concrete.

It will also be appreciated that the connection assembly provided by the combination of the pile caps 14 secured to the free ends of the piles and the attachment members 50 can be used to secure other steel structures to the free ends of piles, examples of such structures being other platforms, columns, bridge elements, tanks, building components, piers, and towers. In those embodiments, the attachment members 50 would be secured to the steel structure as desired, and secured to the pile caps as above-described.

The invention in its broader aspects is, therefore, not limited to the specific details, representative apparatus and method, and illustrative examples shown and described. Accordingly, departures may be made from such details without departing from the spirit or scope of the general inventive concept.

Having described the invention, what is claimed is:

1. An elevated equipment assembly, comprising:

a plurality of piles installed into the ground with free ends thereof extending above grade, a plurality of pile caps coupled to the free ends, each pile cap including a cap plate disposed in a generally horizontal orientation, a platform situated atop the pile caps and including:

two longitudinally-extending structural beams spaced apart and oriented generally parallel with one another, a plurality of cross beams spanning between the two structural beams, the structural beams each having an inboard side and an outboard side, the inboard side of each structural beam facing the inboard side of the other structural beam and the cross beams secured to the inboard side of each structural beam, and a plurality of attachment members secured to and extending outwardly from the outboard side of each structural beam, each attachment member including a generally flat attachment plate disposed in a generally horizontal orientation and resting on and being secured to a cap plate of a respective one of the pile caps, and operating equipment supported atop the platform.

2. The elevated equipment assembly of claim 1, wherein the structural beams each include a lower surface that defines a lower plane of the platform and the attachment plates are generally oriented in the lower plane.

3. The elevated equipment assembly of claim 1, wherein each attachment member includes spaced first and second gusset plates extending upwardly from the attachment plate toward an upper plane of the platform and outwardly from the outboard side of a respective structural beam.

4. The elevated equipment assembly of claim 3, wherein the structural beams each include a lower surface that defines a lower plane of the platform and the attachment plates are generally oriented in the lower plane, and wherein the first and second gusset plates include an upper surface that is generally oriented in the upper plane.

5. The elevated equipment assembly of claim 3, further comprising two longitudinally-extending outer beams, each outer beam positioned outwardly of the outboard side of respective structural beams and secured to the first and second gusset plates.

6. The elevated equipment assembly of claim 1, wherein each cap plate includes a cap plate aperture and each attachment plate includes an attachment plate aperture, and the cap plates and attachment plates are secured together by a fastening member received in respective aligned cap plate apertures and attachment plate apertures.

7. The elevated equipment assembly of claim 1, wherein the operating equipment is bolted to the platform.

8. The elevated equipment assembly of claim 1, further comprising a longitudinally- extending channel rail secured to upper surfaces of the cross beams between the structural beams, a brace bar positioned over a portion of the operating equipment, and tie bar connecting the brace bar with the channel rail to secure the operating equipment to the platform.

9. The elevated equipment assembly of claim 1, wherein each attachment member is generally opposite a respective structural beam from a cross beam.

10. The elevated equipment assembly of claim 1, further comprising a steel grating positioned atop the structural beams.

11. The elevated equipment assembly of claim 1, further comprising a step positioned below the upper plane and providing a surface for a user to step onto.

12. The elevated equipment assembly of claim 11, wherein the structural beams each include a lower surface that defines a lower plane of the platform and the step is positioned generally between the upper plane and the lower plane.

13. The elevated equipment assembly of claim 11, wherein the step includes steel grating.

14. The elevated equipment assembly of claim 1, further comprising a transverse plate positioned generally above the upper plane of the platform at a longitudinal end of the platform.

15. The elevated equipment assembly of claim 1, wherein each pile cap further includes a sleeve portion fitting around a respective free end of a pile.

16. The elevated equipment assembly of claim 15, wherein each sleeve portion includes at least one sleeve aperture and each free end includes at least one corresponding pile aperture, the sleeve portions and piles being secured together by a fastening member received in respective aligned sleeve apertures and pile apertures.

17. The elevated equipment assembly of claim 1, wherein the operating equipment includes an oil pump.

18. The elevated equipment assembly of claim 1, wherein the plurality of piles includes a first plurality of piles oriented generally vertically in the ground and a second plurality of piles oriented generally at an oblique angle in the ground.

19. The elevated equipment assembly of claim 18, wherein the plate caps of the pile caps of the first plurality of piles are oriented generally transverse to a lengthwise axis of a respective pile.

20. The elevated equipment assembly of claim 18, wherein the plate caps of the pile caps of the second plurality of piles are oriented at an oblique angle relative to a lengthwise axis of a respective pile.

21. The elevated equipment assembly of claim 1, wherein the piles are helical piles including helically-arranged blades.

22. The elevated equipment assembly of claim 1, wherein the structural beams each include an upper surface that defines an upper plane of the platform and the attachment plates are generally coplanar with each other in a plane parallel with the upper plane.

23. A method of supporting a piece of operating equipment atop a platform above grade, the platform including two longitudinally-extending structural beams spaced apart and oriented generally parallel with one another, a plurality of cross beams spanning between the two structural beams, the structural beams each having an inboard side and an outboard side, the inboard side of each structural beam facing the inboard side of the other structural beam and the cross beams secured to the inboard side of each structural beam, and a plurality of attachment members secured to and extending outwardly from the outboard side of each structural beam, each attachment member including a generally flat attachment plate, the method comprising:

positioning the platform above a plurality of pile caps above grade, each pile cap including a generally horizontally disposed cap plate and being coupled to a free end of a pile installed into the ground, moving the platform to bring the attachment plates into confronting relationship with the cap plates, resting the attachment plates on the cap plates, securing the attachment plates with the cap plates, and positioning the operating equipment atop the platform.

24. The method of claim 23, further comprising:

before positioning the platform, installing the plurality of piles into the ground.

25. The method of claim 24, wherein the plurality of piles includes a first plurality of piles oriented generally vertically in the ground and a second plurality of piles oriented generally at an oblique angle in the ground.

26. The method of claim 23, further comprising:

before positioning the platform, coupling a pile cap with the free end of each pile.

27. The method of claim 26, further comprising:

before coupling the pile caps, trimming a free end of a pile.

28. The method of claim 23, wherein each attachment plate includes an attachment plate aperture and each cap plate includes a cap plate aperture, and wherein securing the attachment plates with the cap plates includes positioning a fastening member in respective aligned attachment plate apertures and cap plate apertures.

29. The method of claim 23, further comprising: securing the operating equipment to the platform.

30. The method of claim 29, wherein securing the operating equipment includes bolting the operating equipment to the platform.

31. The method of claim 29, wherein the platform includes a longitudinally-extending channel rail secured to upper surfaces of the cross beams between the structural beams, and wherein securing the operating equipment includes positioning a brace bar over a portion of the equipment and connecting the brace bar to the channel rail.

32. The method of claim 23, wherein the plurality of piles includes helical piles having helically-arranged blades.

33. An elevated platform assembly for elevating a piece of operating equipment above grade, comprising:

a plurality of piles configured to be installed into the ground such that free ends thereof extend above grade, a plurality of pile caps, each pile cap being configured to be coupled with a free end of a respective one of the piles and including a cap plate, and a platform for supporting the operating equipment, the platform including two longitudinally-extending structural beams spaced apart and oriented generally parallel with one another, a plurality of cross beams spanning between the two structural beams, the structural beams each having an inboard side and an outboard side, the inboard side of each structural beam facing the inboard side of the other structural beam and the cross beams secured to the inboard side of each structural beam, and a plurality of attachment members secured to and extending outwardly from the outboard side of each structural beam, each attachment member including a generally flat attachment plate, whereby the plurality of piles, the plurality of pile caps, and the platform are assembled with the plurality of piles installed into the ground with free ends thereof extending above grade, with the plurality of pile caps coupled to free ends of respective piles with the cap plates thereof being disposed in a generally horizontal orientation, with the platform set atop the pile caps so the horizontally disposed cap plates and attachment plates are put into confronting relationship in which the attachment plates rest on the cap plates, and with the cap plates and the attachment plates being secured together to couple the platform with the pile caps.

34. A platform for supporting a piece of operating equipment above grade, composing:

two longitudinally-extending structural beams spaced apart and oriented generally parallel with one another, a plurality of cross beams spanning between the two structural beams, the structural beams each having an inboard side and an outboard side, the inboard side of each structural beam facing the inboard side of the other structural beam and the cross beams secured to the inboard side of each structural beam, and a plurality of attachment members secured to and extending outwardly from the outboard side of each structural beam, each attachment member including a generally flat attachment plate configured for resting on a cap plate of a pile cap secured to a free end of a pile installed into the ground, wherein the structural beams each include an upper surface that defines an upper plane of the platform and the attachment plates are generally coplanar with each other in a plane parallel with the upper plane.

35. The platform of claim 34, wherein the structural beams each include a lower surface that defines a lower plane of the platform and the attachment plates are generally oriented in the lower plane.

36. The platform of claim 34, wherein each attachment member includes spaced first and second gusset plates extending upwardly from the attachment plate toward the upper plane of the platform and outwardly from the outboard side of a respective structural beam.

37. The platform of claim 36, wherein the structural beams each include a lower surface that defines a lower plane of the platform and the attachment plates are generally oriented in the lower plane, and wherein the first and second gusset plates include an upper surface that is generally oriented in the upper plane.

38. The platform of claim 36, further comprising two longitudinally-extending outer beams, each outer beam positioned outwardly of the outboard side of respective structural beams and secured to the first and second gusset plates.

39. The platform of claim 34, wherein each attachment plate includes an attachment plate aperture, the attachment plates being configured to be secured to cap plates having cap plate apertures by a fastening member received in respective aligned attachment plate apertures and cap plate apertures.

40. The platform of claim 34, wherein the structural beams include a plurality of tie- down apertures configured to receive a fastener for securing operating equipment to the platform.

41. The platform of claim 34, further comprising a longitudinally-extending channel rail secured to upper surfaces of the cross beams between the structural beams and configured to receive a tie bar for securing operating equipment to the platform.

42. The platform of claim 34, wherein each attachment member is generally opposite a respective structural beam from a cross beam.

43. The platform of claim 34, further comprising a steel grating positioned atop the structural beams.

44. The platform of claim 34, further comprising a step positioned below the upper plane and providing a surface for a user to step onto.

45. The platform of claim 44, wherein the structural beams each include a lower surface that defines a lower plane of the platform and the step is positioned generally between the upper plane and the lower plane.

46. The platform of claim 44, wherein the step includes steel grating.

47. The platform of claim 34, further comprising a transverse plate positioned generally above the upper plane of the platform at a longitudinal end of the platform.

48. The assembly of claim 33, wherein the structural beams each include an upper surface that defines an upper plane of the platform and the attachment plates are generally coplanar with each other in a plane parallel with the upper plane.

49. An adjustable connection system comprising:

a plurality of piles having free ends, the piles adapted to be inserted into the ground such that the free ends of each pile defines a respective angle relative to the pile, a plurality of pile caps coupled to the free ends, each pile cap including a cap plate disposed in a generally horizontal orientation having an aperture therethrough and a threaded fastening member fixedly attached to the cap plate so as to be aligned with the cap plate aperture and a receiver sleeve that mates with the pile free end at an orientation to match the pile free end angle, a steel member adapted to be situated generally horizontally relative to the free ends of the piles, a plurality of attachment members secured to the steel member, each attachment member including a generally flat attachment plate disposed in a generally horizontal orientation having an oversized attachment plate aperture, and including four steel plates arranged to form a box around the perimeter of the attachment plate, the attachment plate being at a bottom of the box, whereby each attachment plate is secured to each cap plate by an attachment assembly including a single threaded fastening member received in respective attachment plate apertures and cap plate apertures, the cap plate fastening member, a second threaded member secured to the fastening member above the attachment plate, and a washer between the second threaded member and the attachment plate.

50. The connection system of claim 49, the piles adapted to be inserted into the ground in a configuration selected from the group consisting of vertical, battered, and a combination of vertical and battered.

* * * * *